US006675749B2

(12) United States Patent
Osakabe

(10) Patent No.: US 6,675,749 B2
(45) Date of Patent: Jan. 13, 2004

(54) COOLING SYSTEM FOR MARINE DRIVE

(75) Inventor: Takayuki Osakabe, Shizuoka (JP)

(73) Assignee: Sanshin Kogyo Kabushiki Kaisha (JP)

( * ) Notice: Subject to any disclaimer, the term of this patent is extended or adjusted under 35 U.S.C. 154(b) by 127 days.

(21) Appl. No.: 10/106,995

(22) Filed: Mar. 26, 2002

(65) Prior Publication Data

US 2002/0166518 A1 Nov. 14, 2002

Related U.S. Application Data

(60) Provisional application No. 60/322,229, filed on Sep. 13, 2001.

(30) Foreign Application Priority Data

Mar. 26, 2001 (JP) ..... 2001-087213

(51) Int. Cl.[7] ..... F01P 1/06

(52) U.S. Cl. ..... 123/41.31; 440/88

(58) Field of Search ..... 123/41.31, 41.14, 123/41.74, 41.28, 41.15; 440/88, 89, 57, 111, 113, 53; 60/321

(56) References Cited

U.S. PATENT DOCUMENTS 4,953,525 A 9/1990 Sakurai et al.
4,955,837 A 9/1990 Yoshimura (List continued on next page.)

FOREIGN PATENT DOCUMENTS

JP 6-42345 2/1999
JP 11-324696 11/1999

OTHER PUBLICATIONS

Parts Catalogue Model Yar 2001, F80TLRZ (67G), F100TLRZ (67F) in 3 Pages.

Parts Catalogue Model Year 2001 150TRZ (64C), in 7 Pages.

Parts Catalogue Model Year 2001, 25 MHZ3 (6K9), 30MHZ (6J8), 30EHZ (6J8), 30ERZ (6J8). in 3 Pages.

Parts Catalogue Model Year 2002, F15MHZ (66M0), F15EHZ (66M0), in 3 Pages.

Parts Catalogue Model Year 2001, DX150TLRZ (67N), in 3 Pages.

Salwater Series, Parts Catalogue Model Year 1995, 225TRT (62J), in 3 Pages.

Parts Catalogue Model Year 2001, VX200TLRZ (66X), VX225TLRZ (66K), in 2 Pages.

Clymer Suzuki Outboard Shop Manual, 75–225 HP Two–S-troke 1992–1999, in 3 Pages.

*Primary Examiner*—Tony M. Argenbright
*Assistant Examiner*—Katrina B. Harris
(74) *Attorney, Agent, or Firm*—Knobbe, Martens, Olson & Bear, LLP.

(57) ABSTRACT

A marine drive has an open loop cooling system for cooling various engine components using water drawn from the body of water in which an associated watercraft is operating. A water inlet of the cooling system has a filter cover which includes a series of apertures through which water can flow. The apertures have a maximum cross-sectional width. After passing through the water inlet, cooling water is pressurized and directed to an engine coolant passage to cool engine components. A pilot water passage branches off of the engine coolant passage and delivers cooling water through peripheral engine components to cool the components. The pilot cooling water is discharged from the marine drive in a pilot water stream that is visible to the operator of the watercraft. No portion of the pilot water passage has a diameter that is less than the maximum dimension of the water inlet filter cover openings.

26 Claims, 10 Drawing Sheets

U.S. PATENT DOCUMENTS 4,991,546 A 2/1991 Yoshimura
5,036,804 A 8/1991 Shibata
5,380,228 A 1/1995 Kawai et al.
5,438,962 A 8/1995 Iwata et al.
5,669,358 A 9/1997 Osakabe
5,797,378 A 8/1998 Kato
5,803,050 A 9/1998 Osakabe et al.
5,823,835 A * 10/1998 Takahashi et al. ..... 440/2
5,873,330 A 2/1999 Takahashi et al.
5,885,121 A 3/1999 Nanami et al.
5,890,472 A 4/1999 Saito
5,921,829 A 7/1999 Iwata
5,975,032 A 11/1999 Iwata
6,022,251 A 2/2000 Ogino
6,053,784 A 4/2000 Takahashi
6,109,987 A 8/2000 Watanabe et al.
6,155,895 A 12/2000 Sato et al.
6,171,158 B1 1/2001 Henmi et al.
6,263,839 B1 * 7/2001 Hoshiba et al. ..... 123/41.08
6,295,955 B1 10/2001 Kato et al.
6,454,622 B2 * 9/2002 Mashiko et al. ..... 440/89 R
6,513,463 B2 * 2/2003 Katayama ..... 123/41.29

* cited by examiner

COOLING SYSTEM FOR MARINE DRIVE

PRIORITY INFORMATION

This application is based on and claims priority to (1) Japanese Patent Application No. 2001-087213, filed Mar. 26, 2001, and (2) U.S. Provisional Patent Application No. 60/322,229, filed Sep. 13, 2001, the entire contents of these prior applications are hereby expressly incorporated by reference.

BACKGROUND OF THE INVENTION

1. Field of the Invention

This invention relates to a cooling system for a marine drive.

2. Description of the Related Art

Power driven watercraft typically include a marine drive to propel the watercraft. Marine drives typically include an engine configured to drive a propulsion device. One common type of marine drive is an outboard motor, which comprises an internal combustion engine disposed atop a drive unit. A propulsion device of the drive unit is driven by the engine. The propulsion device is positioned so that it will be at least partially submerged when the associated watercraft is disposed on a body of water. The engine includes a crankcase, a cylinder block, a cylinder head assembly, and at least several other components.

Engine operation generates significant heat. This heat can accumulate in the engine body unless properly removed. Excessive heat can jeopardize normal engine operations. Typical engines thus have a cooling system to remove heat from portions of the engine body and engine components. Various types of cooling systems are employed.

In one type of cooling system, water from the body of water in which the watercraft is being operated is drawn through a water inlet in the drive unit and is pumped through various cooling jackets in order to cool the crankcase, cylinder block, cylinder head assembly, and other engine components, as well as the exhaust system. However, in some applications, different cooling water may be used to cool portions of the engine and portions of the exhaust system. After cooling the engine and/or the exhaust system, the cooling water is returned to the body of water.

If the cooling system malfunctions such that water is no longer supplied at a desired flow rate to certain portions of the engine, the engine can overheat. This can result in serious engine failure such as seizure of the pistons and malfunction of engine components. A pilot water discharge, or "telltale," is often employed with outboard motors in order to indicate to an operator of the watercraft whether the cooling system is functioning properly. A pilot water discharge assembly generally includes a pilot water passage that branches off the cooling system and delivers a portion of the cooling water to a discharge disposed generally above the body of water. As such, the stream of discharged pilot water is easily visible or audible to the operator.

During normal operation of the cooling system, the stream of discharged pilot water will flow continuously through the pilot discharge. When the flow is continuous, steady and strong, the operator can be confident that the cooling system is working correctly. If the stream of pilot water displays abnormal behavior such as, for example, if the pilot water stream stops or is appreciably diminished, the operator will understand that there is a problem with the cooling system.

The pilot water passage generally has a small inner diameter compared to the water jackets in the engine body and exhaust system. As such, foreign objects that flow freely through the water jackets could become lodged in the relatively small pilot water passage, blocking flow therethrough. A filter is often provided at the point where the pilot water passage branches from the coolant jackets. The filter prevents foreign objects from entering and clogging the pilot water passage. Such a filter must be cleaned periodically to remove foreign debris. Cleaning of the filter takes time and effort and must be done regularly or else the efficacy of the pilot water discharge will be diminished. Also, if any components are to be cooled via the pilot water passage, cooling of such components may be diminished if the filter is not regularly cleaned.

SUMMARY OF THE INVENTION

In accordance with one aspect, the present invention provides an outboard motor comprising a power head having an engine, a driveshaft housing, a lower unit comprising a propulsion device, and an open loop cooling system. The engine drives the propulsion device and has an engine body. The cooling system has a water inlet formed through the lower unit and has at least one opening. An engine coolant passage is formed in the engine body. A pilot water passage receives a flow of water from the water inlet and directs the flow of water through at least one engine component. A minimum cross-sectional dimension of the pilot water passage along its length is never less than a maximum cross-sectional dimension of the at least one water inlet opening.

In accordance with another aspect, a marine drive is provided having an engine, a propulsion device, and an open loop cooling system. The engine is coupled to the propulsion device and has an engine body. The cooling system has a water inlet having at least one opening. An engine coolant passage is formed in the engine body and has an engine coolant discharge. The cooling system also comprises a pilot water passage. A water pump is configured to deliver water from the water inlet to the engine coolant passage and pilot water passage. The pilot water passage directs a flow of water through a pilot water discharge that is spaced from the engine coolant discharge. A cross-sectional dimension of the pilot water passage along its length is no less than a maximum cross-sectional dimension of the at least one water inlet opening.

Further aspects, features and advantages of this invention will become apparent from the detailed description of the preferred embodiment which follows.

BRIEF DESCRIPTION OF THE DRAWINGS

These and other features, aspects and advantages of the present invention will now be described with reference to the drawings of a preferred embodiment, which is intended to illustrate and not to limit the invention. The drawings comprise 10 figures.

DETAILED DESCRIPTION OF THE PREFERRED EMBODIMENT

Figure 1:
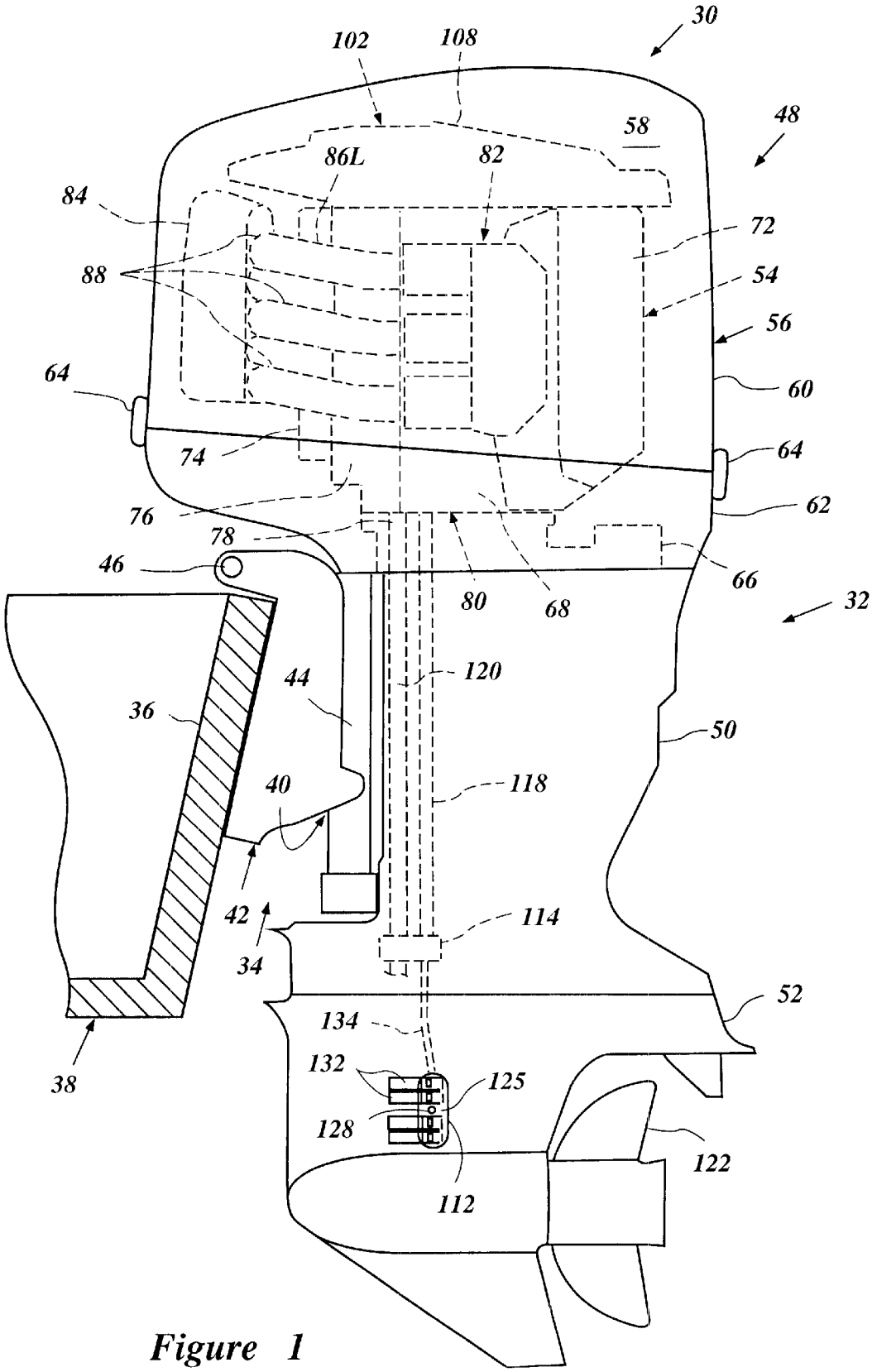
FIG. 1 is a side elevational view of an outboard motor comprising a cooling system arranged in accordance with an embodiment of the present invention. A number of cooling system and engine components are shown in phantom. A watercraft associated with the outboard motor is partially shown in section.
Figure 2:
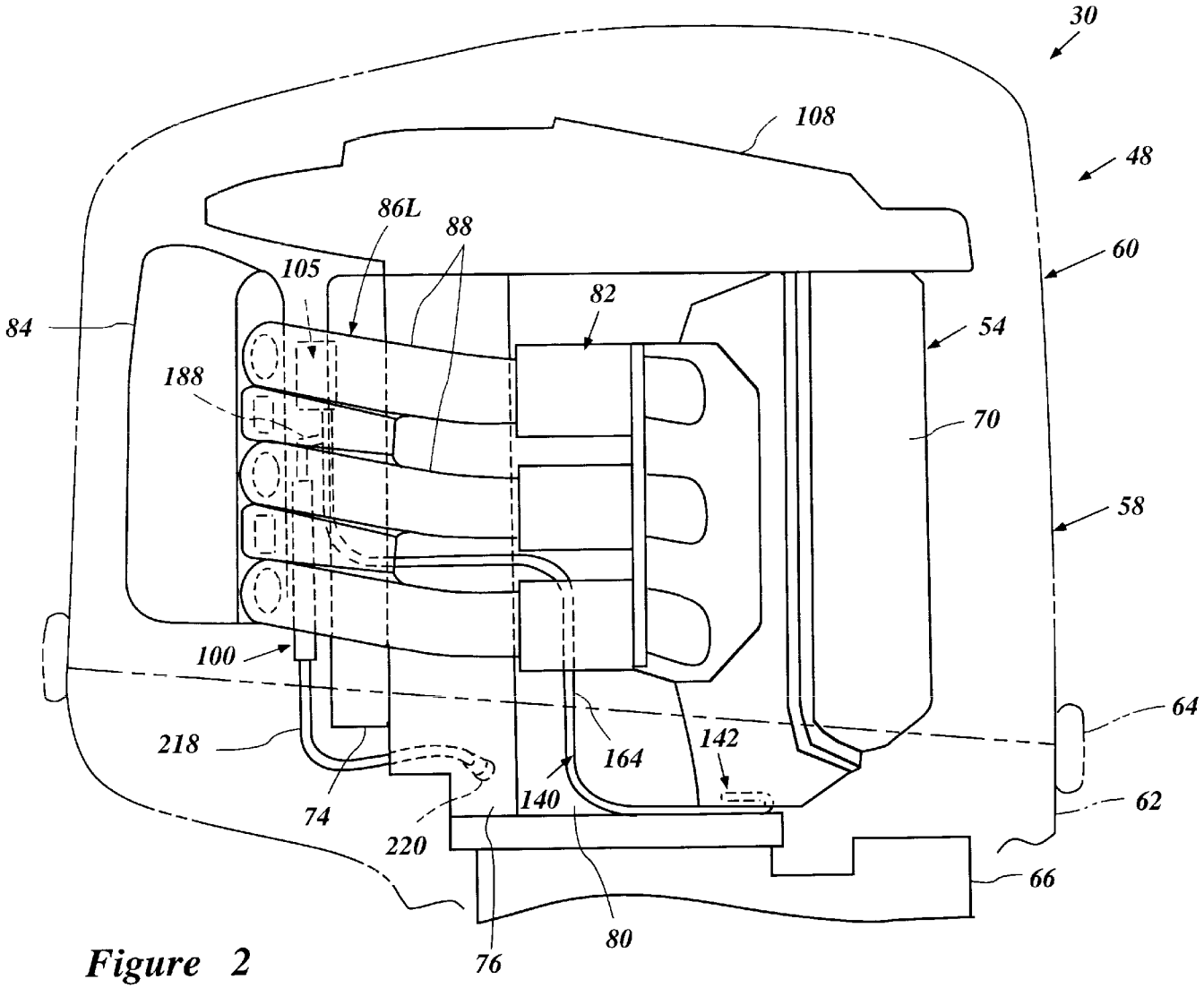
FIG. 2 is a side elevational view of a power head of the outboard motor of FIG. 1, which includes an engine disposed within a cowling (shown in phantom). A pilot water passage of the cooling system is also shown.
Figure 3:
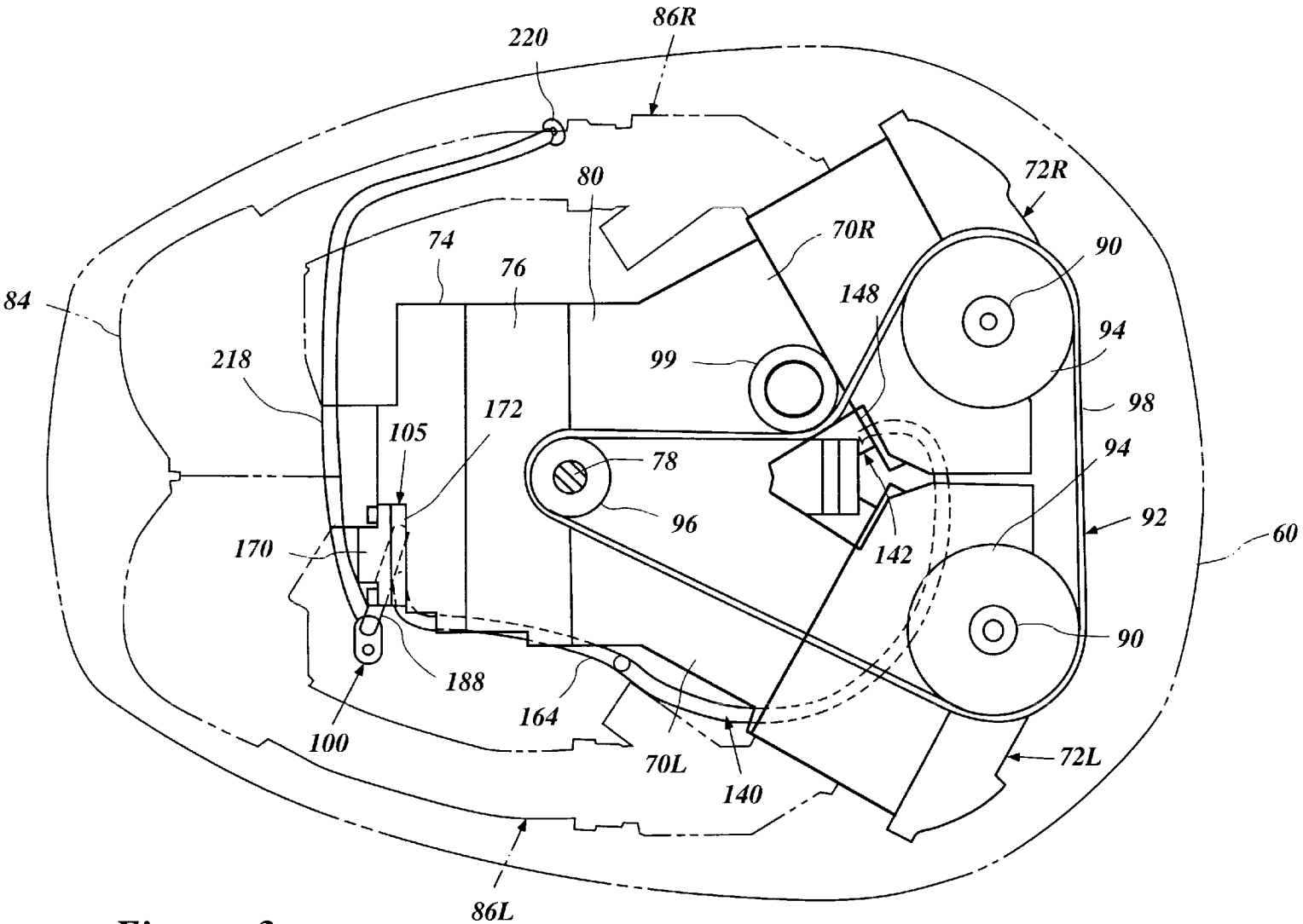
FIG. 3 is a top plan view of the power head of FIG. 2.

With reference first to FIGS. 1–3, an overall construction of an outboard motor 30, which employs a cooling system arranged in accordance with certain features, aspects and advantages of the present invention, will be described. In the illustrated arrangement, the outboard motor 30 comprises a drive unit 32 and a bracket assembly 34. The bracket assembly 34 supports the drive unit 32 on a transom 36 of an associated watercraft 38 and places a marine propulsion device in at least a partially submerged position with the watercraft 38 resting on the surface of a body of water. The bracket assembly 34 preferably comprises a swivel bracket 40, a clamping bracket 42, a steering shaft 44 and a pivot pin 46.

The steering shaft 44 typically extends through the swivel bracket 40 and is affixed to the drive unit 32. The steering shaft 44 is pivotally journaled for steering movement about a generally vertically-extending steering axis defined within the swivel bracket 40. The clamping bracket 42 comprises a pair of bracket arms that are spaced apart from each other and that are affixed to the watercraft transom 36. The pivot pin 46 completes a hinge coupling between the swivel bracket 40 and the clamping bracket 42. The pivot pin 46 extends through the bracket arms so that the clamping bracket 42 supports the swivel bracket 40 for pivotal movement about a generally horizontally-extending tilt axis defined by the pivot pin 46. The drive unit 32 thus can be tilted or trimmed about the pivot pin 46.

As used through this description, the terms "forward," "forwardly" and "front" mean at or to the side where the bracket assembly 36 is located, and the terms "rear," "reverse," "backwardly" and "rearwardly" mean at or to the opposite side of the front side, unless indicated otherwise or otherwise readily apparent from the context use.

A hydraulic tilt and trim adjustment system preferably is provided between the swivel bracket 40 and the clamping bracket 42 to tilt (raise or lower) the swivel bracket 40 and the drive unit 32 relative to the clamping bracket 42. Otherwise, the outboard motor 30 can have a manually operated system for tilting the drive unit 32. Typically, the term "tilt movement", when used in a broad sense, comprises both a tilt movement and a trim adjustment movement.

The illustrated drive unit 32 comprises a power head 48, a driveshaft housing 50 and a lower unit 52. The power head 48 is disposed atop the drive unit 32 and comprises an internal combustion engine 54 that is positioned within a protective cowling 56. The protective cowling 56 preferably defines a generally closed cavity 58 in which the engine 54 is disposed. In the illustrated embodiment, the protective cowling 56 comprises a top cowling member 60 and a bottom cowling member 62. The top cowling member 60 is preferably detachably affixed to the bottom cowling 62 by a coupling mechanism 64 so that a user, operator, mechanic or repair person can access the engine 54 for maintenance or for other purposes.

The top cowling 60 preferably has at least one air intake opening (not shown) and at least one air duct disposed on its rear and top portion. Ambient air is drawn into the closed cavity 58 from within the opening through the duct.

The bottom cowling member 62 preferably has an opening at its bottom portion through which an upper portion of an exhaust guide member 66 extends. The exhaust guide member 66 is affixed atop the driveshaft housing 50. The bottom cowling member 62 and the exhaust guide member 66 together generally form a tray. The engine 54 is placed onto this tray and is affixed to the exhaust guide member 66. The exhaust guide member 66 also has an exhaust passage through which burnt charges (e.g., exhaust gases) from the engine 54 are discharged.

The engine 54 in the illustrated embodiment operates on a four-stroke combustion principle. With particular reference to FIGS. 2 and 3, the engine 54 has a cylinder block 68 which defines six cylinder bores disposed in two banks 70L, 70R of three cylinders each. Each bore extends generally horizontally and is generally vertically spaced from the other bores in the bank. The cylinder banks 70L, 70R extend generally vertically and are oriented generally in a "V" shape relative to one another. The term "horizontally" means that the subject portions, members or components extend generally in parallel to the surface of the body of water in which the associated watercraft is resting when the drive unit 32 is not tilted and is placed in the position shown in FIG. 1. The term "vertically" in turn means that portions, members or components extend generally normal to those that extend horizontally.

The illustrated "V-6" engine merely exemplifies one type of engine on which various aspects and features of the present invention can be suitably used. Engines having other number of cylinders, having other cylinder arrangements (e.g., in line), and operating on other combustion principles (e.g., crankcase compression two-stroke or rotary) also can employ various features, aspects and advantages of the present invention.

In the illustrated embodiment, each cylinder bore has a piston reciprocatedly disposed therein. A cylinder head assembly 72L, 72R is attached to each cylinder bank 70L, 70R and closes the end of each bore in the respective cylinder bank. Combustion chambers are defined between each associated cylinder head assembly 72L, 72R, cylinder bore and piston. A crankcase cover 74 closes the other end of the cylinder block and defines a crankcase chamber 76 together with the cylinder block. A crankshaft 78 extends generally vertically through the crankcase chamber 76. Connecting rods couple the crankshaft 78 with the respective pistons so that reciprocating movement of the pistons drives the crankshaft 78.

Generally, the cylinder block 68, the cylinder head members 72L, 72R and the crankcase chamber 76 together define an engine body 80. The crankcase 76 is preferably located at the most forward position of the engine body 80, with the cylinder block 68 and the cylinder head member 72 extending rearward from the crankcase, one after another. Preferably, at least these major engine portions 68, 72, 76 are made of aluminum based alloy. The aluminum alloy advantageously increases strength over cast iron while decreasing the weight of the engine body 80.

With continued reference to FIGS. 1–3, an air induction system 82 of the engine draws air from within the cavity 58 of the cowling and delivers it to the combustion chambers. The air induction system 82 preferably comprises a plenum chamber 84 and two intake manifolds 86L, 86R, one manifold on each side of the engine. Each manifold 86L, 86R comprises three intake runners. Air enters the plenum chamber 84 and is delivered by the runners to respective combustion chambers. In one configuration, intake valves open and close respective intake ports in the cylinder head assemblies 72L, 72R in order to regulate delivery of air to the combustion chambers.

The engine 54 also comprises an exhaust system that discharges the burnt charges or exhaust gases to a location outside of the outboard motor 30. Exhaust ports are defined in each cylinder head assembly 72L, 72R to provide access to each combustion chamber. The exhaust ports are repeatedly opened and closed by exhaust valves to regulate flow through the exhaust ports.

An exhaust manifold communicates with the exhaust ports to collect exhaust gases from the combustion chambers through the ports. The exhaust manifold preferably extends generally vertically downwardly to deliver exhaust products to exhaust passages located in the driveshaft housing and lower unit. Exhaust gases preferably are eventually discharged from the motor through exhaust discharge ports.

A valve cam mechanism preferably is provided for actuating the intake and exhaust valves. In the illustrated embodiment, the cylinder head assemblies 72L, 72R each journal an intake camshaft (not shown) and an exhaust camshaft 90. The camshafts extend generally vertically and in parallel to each other. The intake camshaft actuates the intake valves, while the exhaust camshaft 90 actuates the exhaust valves. The respective camshafts have cam lobes to push the intake and exhaust valves in a controlled timing to open and close the intake and exhaust ports. In other embodiments, a single camshaft can replace the intake and exhaust camshafts in a manner that is well known. Of course, other valve drive mechanisms can be employed instead of such a mechanism using one or more camshafts.

A camshaft drive mechanism 92 is provided for driving the valve cam mechanism. As seen in FIG. 3, the exhaust camshafts 90 have driven sprockets 94 positioned atop thereof and the crankshaft 78 has a drive sprocket 96 positioned almost atop thereof. A timing chain or belt 98 is wound around the drive and driven sprockets 96, 94. The crankshaft 78 thus drives the camshafts 90 through the timing chain 98 in a timed relationship. A tensioner 99 preferably abuts a side of the timing chain 98 so as to give proper tension to the chain 98. A diameter of the driven sprockets 94 preferably is twice as large as a diameter of the drive sprocket 96. The exhaust camshafts 90 thus rotate at half of the rotation speed of the crankshaft 78. The exhaust camshafts 90, in turn, drive the intake camshafts.

The engine preferably has a fuel injection system (not shown) for delivering fuel to the combustion chambers. The fuel injection system preferably comprises a series of fuel injectors arranged so that one fuel injector is allotted for each of the respective combustion chambers. Any desired type of fuel injection system such as, for example, a port, manifold or direct injection system, can be suitably employed. Of course in other arrangements, carburetors can replace or accompany the fuel injectors.

The fuel injectors deliver fuel under control of an electronic control unit (ECU). The ECU electronically controls the fuel injectors so that a desired amount of fuel is delivered at a selected timing for a selected duration. As such, a proper amount of fuel is delivered to the engine for each combustion cycle. A fuel rail supports and delivers fuel to the fuel injectors.

The fuel injection system further comprises a fuel supply tank that preferably is placed in the hull of the associated watercraft. Fuel is drawn from the fuel tank by a low pressure fuel pump, through a fuel supply conduit, and is delivered to a vapor separator. A high pressure fuel pump preferably is provided in the vapor separator. The high pressure fuel pump pressurizes fuel for delivery to the fuel injectors through delivery conduits and the fuel rails. The fuel injection system can also include a fuel cooler 100, which will be discussed in more detail below in connection with the cooling system.

The engine 54 also has an ignition or firing system (not shown). Each combustion chamber is provided with a spark plug. The spark plugs have electrodes that are exposed into the associated combustion chamber and that ignite an air/fuel charge in the combustion chamber at selected ignition timing. The ignition system preferably has an ignition coil and an igniter. Ignition timing is controlled by the ECU. In order to enhance or maintain engine performance, the ignition timing can be advanced or delayed in response to various engine running conditions.

The engine 54 also comprises a closed-loop type lubrication system (not shown). The lubrication system comprises a lubricant oil reservoir preferably positioned within the driveshaft housing 50. An oil pump is provided at a desired location, such as atop the driveshaft housing 50, to pressurize the oil in the reservoir and to pass the oil through lubricant delivery passages toward engine portions. Engine portions that should be lubricated include, for instance, the crankshaft bearings, the connecting rods and the pistons. Lubricant return passages also are provided to return the oil to the oil reservoir for re-circulation. Preferably, the lubrication system further comprises a filter assembly to remove foreign matter from the oil (e.g., metal shavings, dirt, dust and water) before the oil is recirculated or delivered to the various engine portions.

A flywheel assembly 102 preferably is positioned above the engine body 80. The flywheel assembly 102 preferably comprises a flywheel magneto or generator that generates electric power (i.e., AC power). A rectifier-regulator assembly 105 is provided to rectify and regulate the AC power generated by the flywheel 102, and the power is accumulated in a battery so that various electrical components, such as the fuel injection system, the ignition system, and the ECU, can use DC power. The flywheel magneto 162 generally comprises a rotor and a stator and can be constructed in any suitable manner. The battery preferably is placed in the hull of the watercraft.

A protective cover 108 is detachably mounted atop the engine body 80 to extend over at least a portion of the flywheel assembly 102 and the camshaft drive mechanism 92. The protective cover 108 is useful to protect the flywheel assembly 102 and the drive mechanism 92, which include moving parts, when the top cowling 60 is detached.

As discussed above, during engine operation, heat builds in the engine body 80, the exhaust manifold, and in various peripheral engine components disposed around the engine body 80. The cooling system is provided to help cool such engine portions and engine components.

As used through this description, the term "peripheral engine components" means all systems, apparatus, devices, accessories, conduits, components, members, elements and the other things that are disposed externally around the engine body 80 in connection with engine operations.

With regard to the engine body 80, an engine coolant passage 110 (see FIG. 6) comprises one or more water jackets that preferably extend through or alongside portions of the engine body so that flowing cooling water can remove at least some of the heat accumulating in the engine portions. In a preferred open loop cooling system, cooling water is drawn into the cooling system from the body of water surrounding the outboard motor through a water inlet 112 and is pressurized by a water pump 114. In other embodiments, the water inlet can operate to scoop water into the cooling system without using a pump when the watercraft is moving forwardly. The water inlet 112 comprises apertures formed through the lower unit 52 at a level that will generally remain submerged when the drive unit 32 is fully or almost fully tilted down. The water pump 114, in turn, is disposed in the driveshaft housing 50.

Water drawn through the water inlet 112 is pressurized and delivered to a water supply conduit 118, which in turn directs the water to the engine coolant passage 110 so that the water flows through the water jackets disposed adjacent portions of the engine. At least some of the water that has cooled the engine portions is discharged from the engine coolant passage 110 into one or more internal portions of the driveshaft housing 50. The cooling system will be described in more detail below.

As seen in FIG. 1, the driveshaft housing 50 depends from the power head 48 and supports a driveshaft 120 which is driven by the crankshaft 78. The driveshaft 120 extends generally vertically through the driveshaft housing 50. The driveshaft 120 preferably drives the water pump 114 and the oil pump. The driveshaft housing 50 also defines internal passages which form portions of the exhaust system.

The lower unit 52 depends from the driveshaft housing 50 and supports a propulsion shaft, which is driven by the driveshaft 120. The propulsion shaft extends generally horizontally through the lower unit 52. A propulsion device is attached to the propulsion shaft and is powered through the propulsion shaft. In the illustrated arrangement, the propulsion device is a propeller 122 that is affixed to an outer end of the propulsion shaft. The propulsion device, however, can take the form of a dual counter-rotating system, a hydrodynamic jet, or any of a number of other suitable propulsion devices.

A transmission preferably is provided between the driveshaft 120 and the propulsion shaft. The transmission couples together the two shafts, which lie generally normal to each other (i.e., at a 90° shaft angle) with bevel gears. The outboard motor 30 has a switchover or clutch mechanism that allows the transmission to change the rotational direction of the propeller 122 among forward, neutral or reverse.

The lower unit 52 also defines an internal passage that forms a discharge section of the exhaust system. At engine speeds above idle, the exhaust gases generally are discharged to the body of water surrounding the outboard motor 30 through the internal passage and finally through an outlet passage defined through the hub of the propeller 122. Of course, an above-the-water discharge can be provided for lower speed engine operation.

The water that is discharged into the driveshaft housing 50 after cooling the engine preferably is used to cool the internal passages of the driveshaft housing 50 and the lower unit 52. In one configuration, the water is collected in a portion of the lower unit 52 and then is discharged to the body of water through a discharge port or through the hub of the propeller 122 along with the exhaust gases.

The cooling system will now be described in greater detail. As described above, cooling water is introduced into the motor through the water inlet 112. With specific reference to FIGS. 1, 4 and 5, the water inlet 112 comprises apertures formed through each side of the lower unit 52. An inlet cover 125 is positioned over each aperture and is secured in place with a bolt 128. It is to be understood that another embodiment can employ an aperture on only one side of the lower unit.

Figure 4:
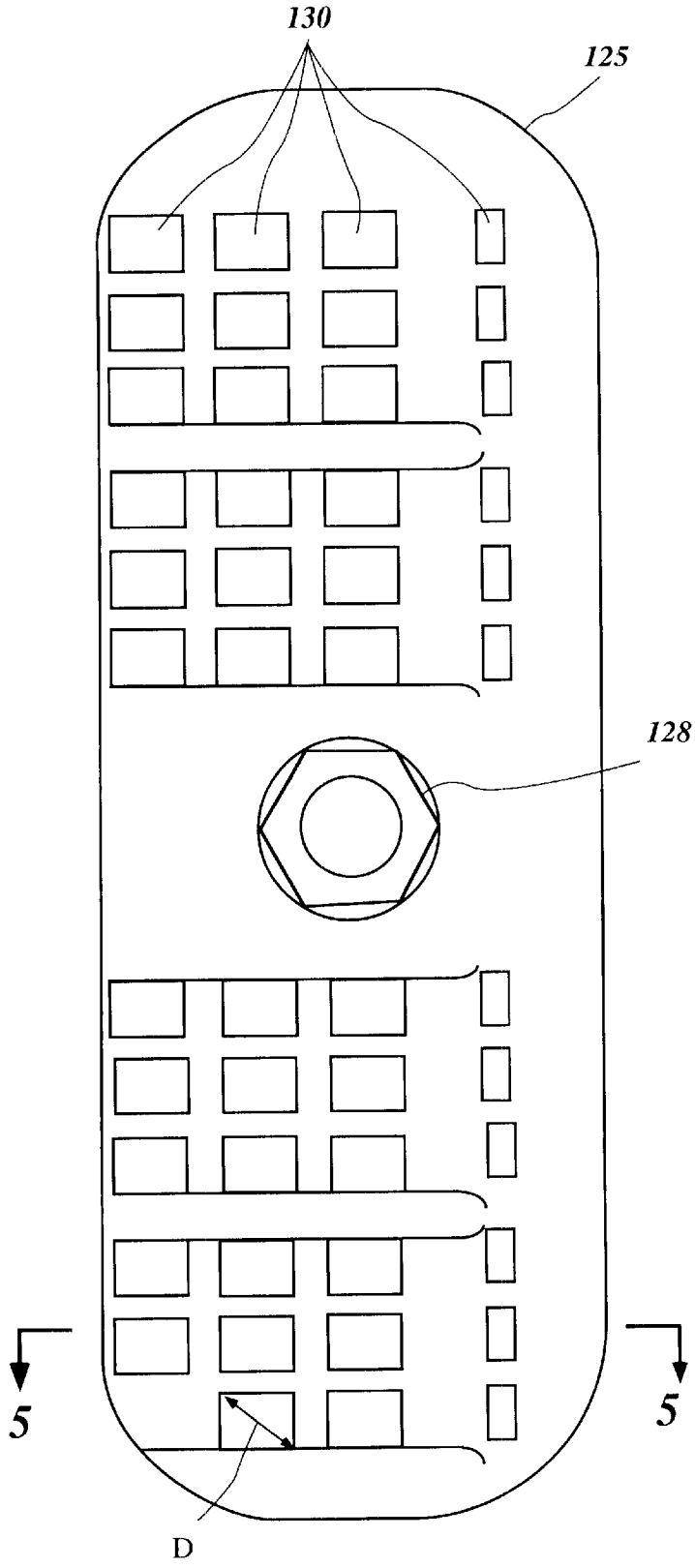
FIG. 4 is an enlarged plan view of a water inlet cover for use with the outboard motor of FIG. 1.
Figure 5:
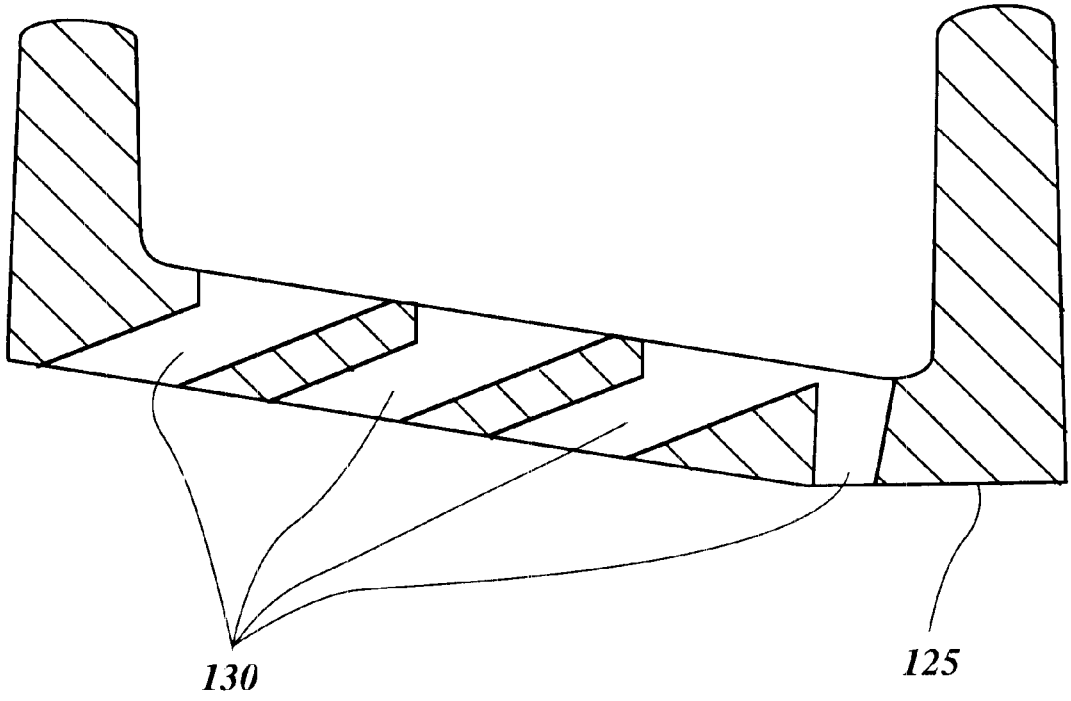
FIG. 5 is a cross-sectional view of the water inlet cover taken along line 5—5 of FIG. 4.

FIGS. 4 and 5 more clearly illustrate the water inlet cover 125. As shown, the cover 125 comprises a plurality of openings 130 which permit water to pass through the cover, but which collectively function as a filter to prevent large debris from entering and fouling the cooling system. In the illustrated embodiment, the openings 130 generally have a rectangular cross-sectional shape, and are arranged in a rectangular grid-like pattern.

Although the water inlet cover openings 130 are small enough to prevent most debris from entering the cooling system, some foreign matter, such as very small rocks, sand and other debris may pass through the openings. In the illustrated embodiment, a diagonal corner-to-corner measurement indicates a maximum dimension D of the openings 130. Debris larger than the maximum dimension D will be blocked from passing through the openings. Debris small enough to pass through the openings 130 will be small enough to flow through the water jackets of the engine coolant passage 110 without fouling or plugging the passage.

Figure 6:
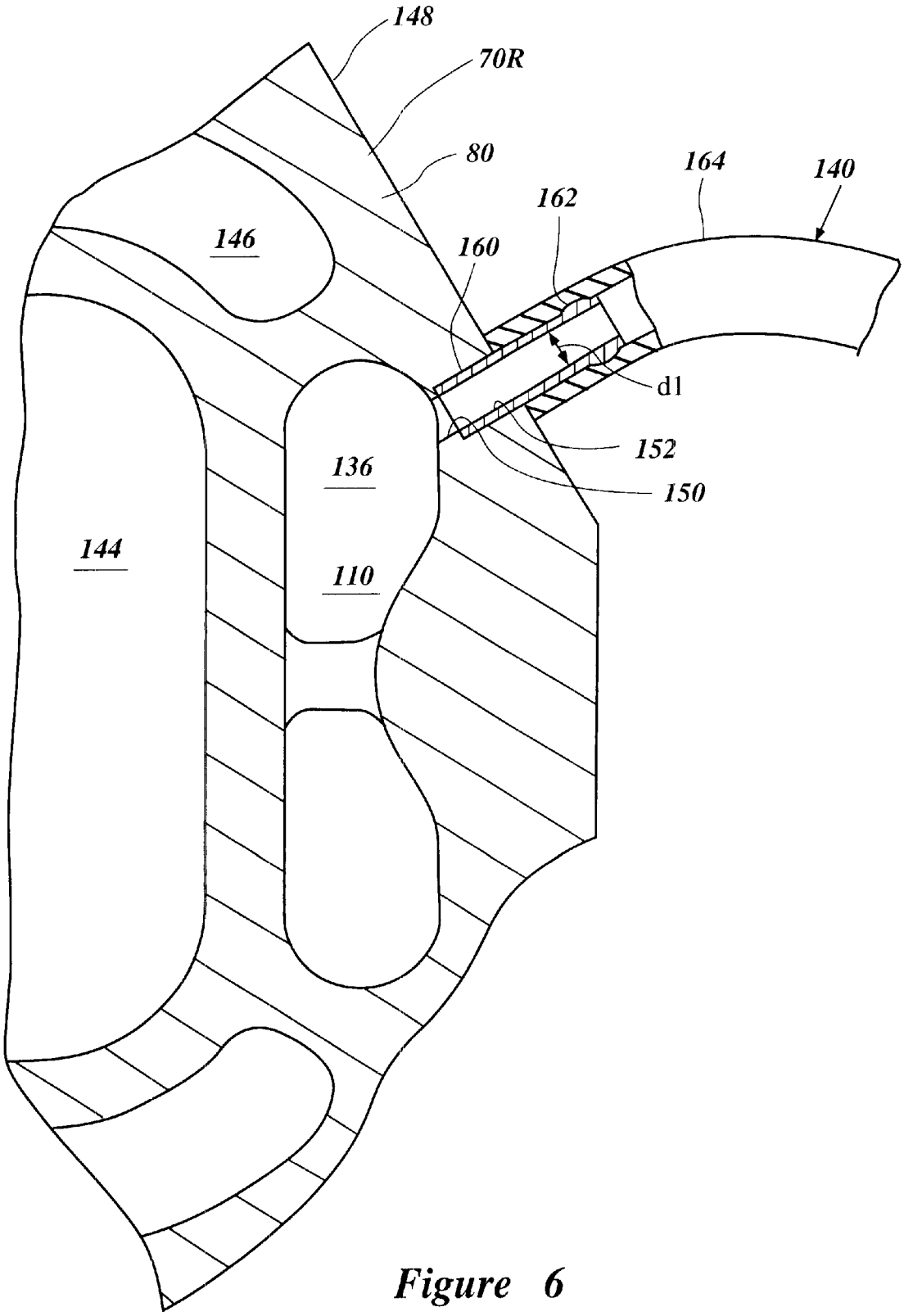
FIG. 6 is a partial sectional view of a portion of the engine body, and shows an upstream end of the pilot water passage of FIG. 2 branching off of a coolant passage of an engine.

With continued reference to FIG. 6, the illustrated openings 130 do not all have the same size and configuration. As such, the maximum cross-sectional dimension of one opening may be greater or less than that of another opening. It is to be understood that D is measured in the opening having the greatest cross-sectional dimension of all of the openings 130 in the cover 125. Additionally, although the illustrated cover 125 includes many openings 130, it is to be understood that another embodiment may employ just a few openings or even only one opening.

As shown most clearly in FIG. 5, most of the openings 130 are slanted generally forwardly. As such, when the watercraft is moving forwardly through a body of water, water will flow freely into and through the openings 130 and through the water inlet 112. A radius of curvature of the cover 125 generally matches that of the outer surface of the lower unit 52 about the location of the inlet 112. As such, each cover 125 fits generally flush with the outer surface of the lower unit. As shown in FIG. 1, a series of depressions or channels 132 are formed in the outer surface of the lower unit 52 adjacent and forwardly of the water inlet 112. The channels 132 help direct water flow into the cover openings 130

Although the illustrated embodiment employs rectangular openings, it is to be understood that openings having other cross-sectional shapes such as, for example, circular or elliptical shapes, can be used. In such embodiments, the maximum dimension D can be the diameter or major axis of the opening.

Water that enters the water inlet 112 is delivered via a conduit 134 to the water pump 114, which pressurizes the water and delivers the water through the delivery conduit 118 to the engine coolant passage 110. The engine coolant passage generally comprises a series of water jackets and conduits configured in a generally conventional manner so as to cool various engine components such as the exhaust manifold, cylinder block and cylinder head. In the illustrated embodiment, an upstream end 136 of the engine coolant passage is disposed at the bottom of the engine 54. The engine coolant passage 110 receives water from the delivery conduit 118 and delivers the cooling water to an exhaust manifold water jacket, further to a cylinder bore water jacket, and then to water jackets in the cylinder head assemblies 72L, 72R. Cooling water then drains to an exhaust passage of the exhaust guide to mingle with and cool engine exhaust or to other coolant passages formed in the driveshaft housing 50.

With particular reference to FIGS. 2, 3 and 6, a pilot water passage 140 branches off of the engine coolant passage 110 at a location near or at the bottom of the engine 54. More precisely, an upstream end 142 of the pilot water passage 140 is connected to the upstream end 136 of the engine coolant passage 110. FIG. 6 shows a portion of a cross section of the engine body 80 taken at the bottom portion of the engine body. At this point, an exhaust passage 144 of the exhaust manifold is formed through the engine body 80, and a water jacket 146 is formed around and adjacent the exhaust passage 144. The water jacket 146 comprises the upstream portion 136 of the coolant passage 110, to which pressurized water from the water pump 114 is delivered via the water delivery conduit 118.

With continued reference to FIGS. 2, 3 and 6, the upstream end 142 of the pilot water passage 140 connects to the upstream end 136 of the engine coolant passage 110 through a wall 148 of the right cylinder bank 70R. A hole 150 is formed through the wall 148 and into the coolant passage. A portion of the hole 150 is further removed so as to form a seat 152. The seat 152 is configured to complementarily accept an elongate tubular connector 160. The connector 160 fits securely in the seat 152 and extends outwardly from the engine body 80. In the illustrated embodiment, there is no filter between the pilot water passage 140 and the engine coolant passage 110.

An inner diameter d1 of the connector 160 preferably is the same as or greater than the maximum dimension D of the water inlet cover openings 130. As such, any debris that passes through the water inlet cover 125 will also be able to flow through the connector 160 without obstructing or plugging the connector 160. The connector 160 has a bump or ridge 162 formed along an outer surface thereof.

In the illustrated embodiment, the pilot water passage 140 comprises rubber tubing 164 that fits over the connector 160. The inner diameter of the tubing 164 is generally greater than the inner diameter d1 of the connector 160, and the hose 164 fits securely over the connector 160. The rubber tubing 164 preferably has a consistent quality so that the inner diameter remains generally consistent throughout the length of the passage 140, including bent portions of the passage. Additionally, since the rubber hose 164 is flexible, it is relatively simple to direct the hose to any desired location about the engine 54 in order to deliver pilot cooling water to various engine components, as will be discussed below.

It is to be understood that, in other embodiments, the pilot water passage can comprise other materials such as, for example, flexible or rigid plastic hose and/or metal tubing. Also, hose or tubing of various cross-sectional shapes can be employed, including circular, rectangular, elliptical, and the like.

With reference again to FIGS. 2 and 3, the rectifier-regulator assembly 105 is mounted on the crankcase cover 74 of the engine 54 between the engine body 80 and the plenum chamber 84. As discussed above, the rectifier-regulator 105 rectifies AC power that is generated by the flywheel magneto 102 to DC power, and also regulates the power under a pre-set voltage. The rectification and regulation is accompanied with production of heat; thus, it is desirable to cool the rectifier-regulator. Additionally, heat from the engine body 80 may be transferred to the rectifier-regulator assembly 105.

Figure 7:
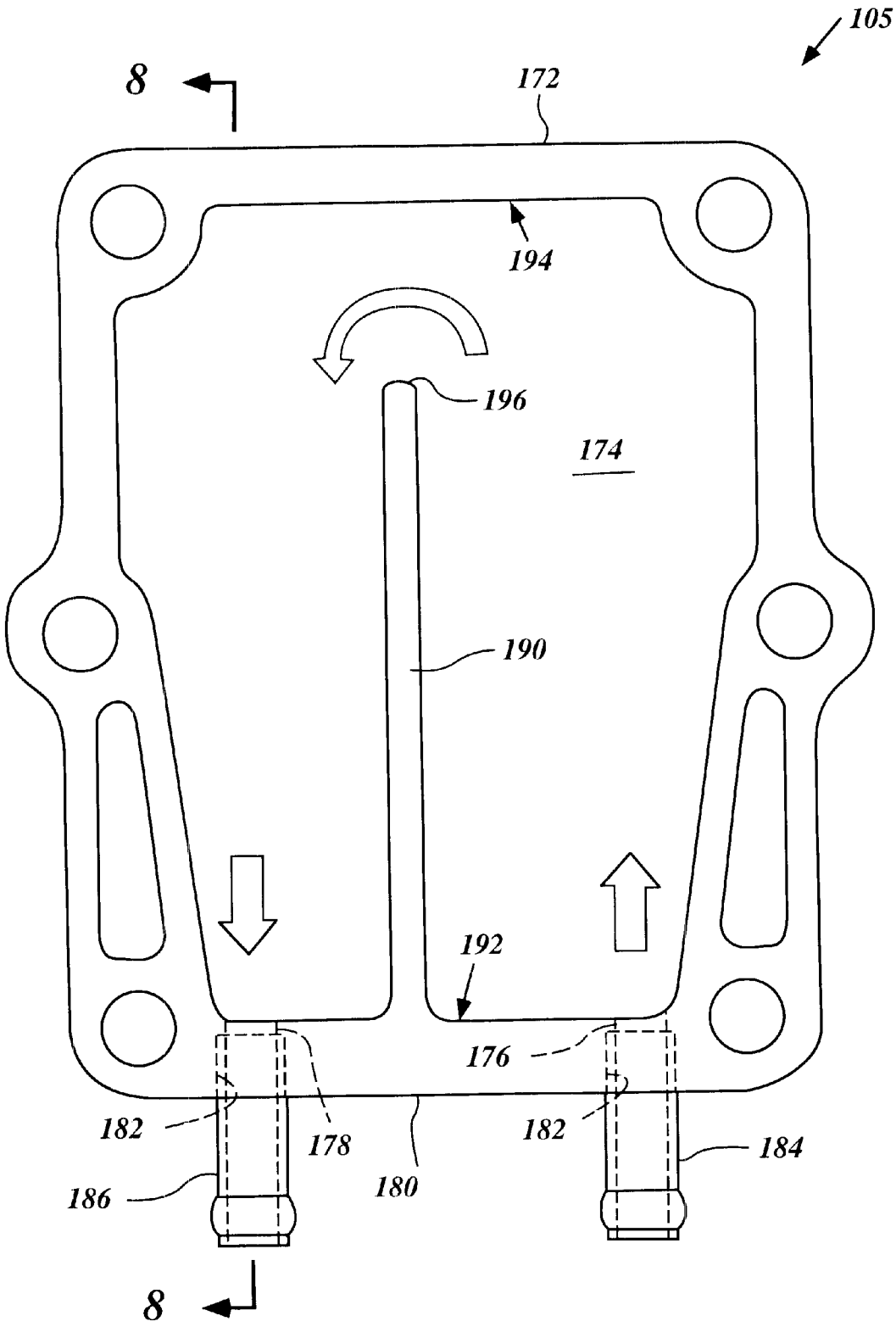
FIG. 7 shows a cooling jacket associated with a rectifier-regulator of an electrical system of the outboard motor. The cooling jacket is disposed within the pilot water passage of FIG. 2.
Figure 8:
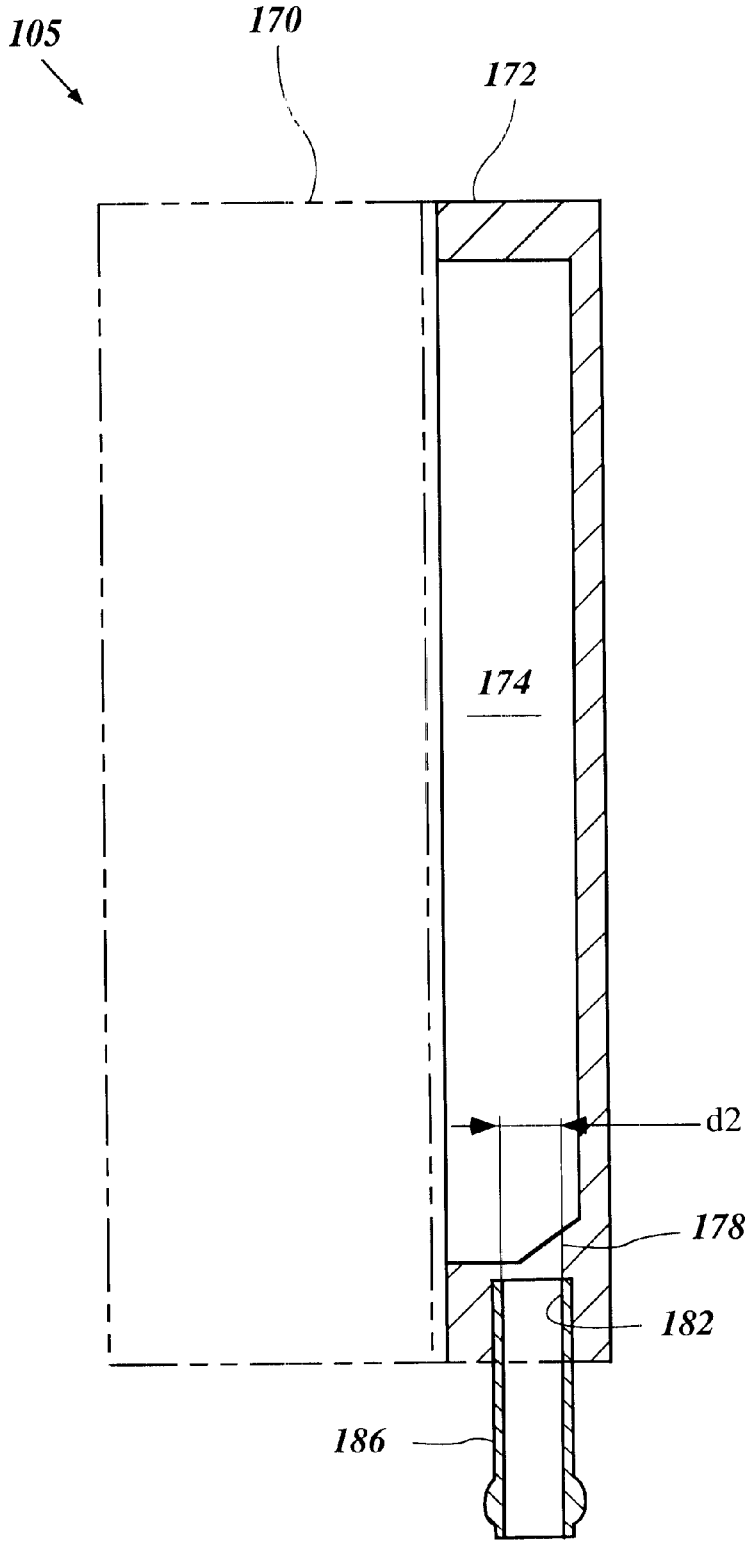
FIG. 8 is a cross-sectional view of the rectifier-regulator of FIG. 7 taken along line 8—8 of FIG. 7.

With reference also to FIGS. 7 and 8, the rectifier-regulator 105 typically is confined within a metallic case 170. A heat exchange block 172 is attached to a surface of the case 170. Bolts or other fastening connections, such as adhesives, can be used to couple the block with the case and to attach the rectifier-regulator assembly 105 to the crankcase cover 74.

A water jacket 174 is defined within the rectifier-regulator block 172. An inlet hole 176 and an outlet hole 178 are formed through a bottom end 180 of the block 172. Seat portions 182 are formed in the holes 176, 178, and connectors 184, 186 are securely fit within the seats 182 after the manner discussed above with reference to the upstream end 142 of the pilot water passage 140. The pilot water hose 164 is connected to the inlet connector 184 so that pilot water that has been drawn from the engine coolant passage 110 is directed into the block water jacket 174. A second pilot water hose 188 (see FIG. 2) is connected to the outlet connector 186.

A divider wall 190 is disposed within the water jacket 174 between the inlet 184 and outlet 186. The divider 190 extends upwardly from the bottom 192 of the jacket 174, stopping short of the top 194 of the jacket. As such, a flow path is defined within the water jacket 174 so that water delivered through the inlet connector 184 flows upwardly toward the top of the water jacket, around an upper end 196 of the divider 190, and then downwardly to the outlet connector 186.

The inlet and outlet connectors 184, 186 preferably are formed similar to the upstream connector 160 discussed above, and have inner diameters d2 that are the same as or greater than the maximum dimension D of the water inlet cover openings 130. Also, no part of the block water jacket 174 has a width less than D. As such, any debris that is small enough to pass through the openings 130 will also be able to pass through the connectors 184, 186 and the block water jacket 174.

In the illustrated embodiment, the block 172 is made of an aluminum-based alloy. In additional embodiments, other materials, such as stainless steel and brass, can be used to construct the block or can be used as liners within the block in order to better protect the block from corrosion by sea water.

Figure 9:
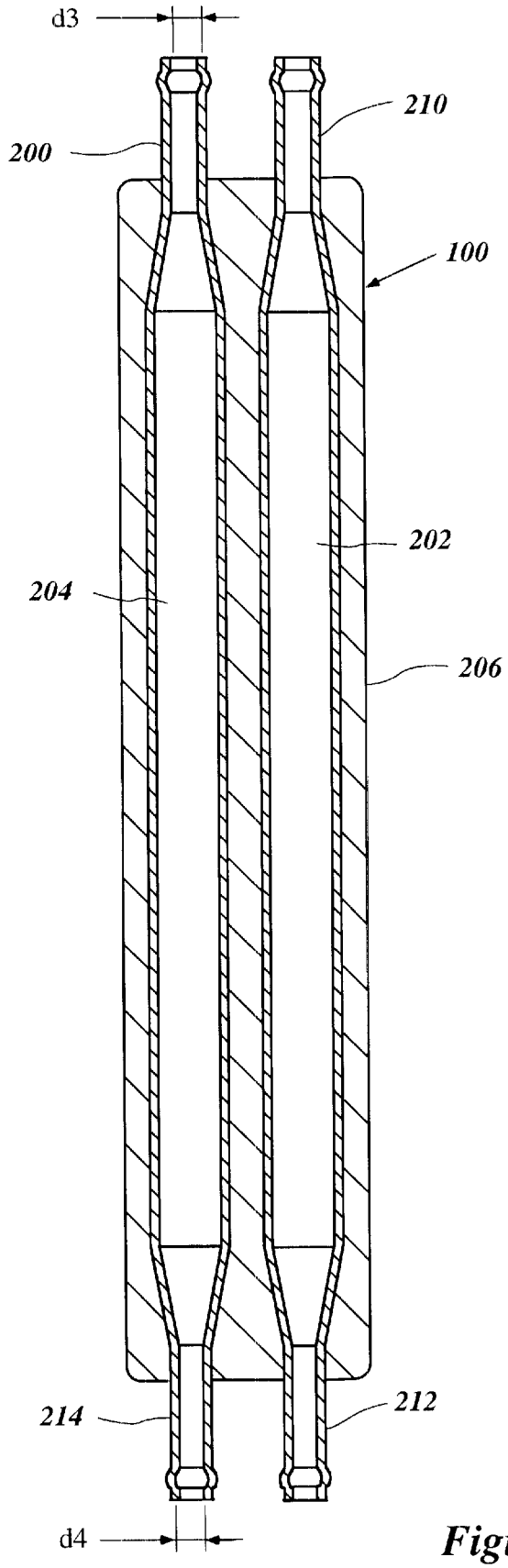
FIG. 9 shows a cross-sectional view of a fuel cooler system having features in accordance with the present invention and disposed within the pilot water passage of FIG. 2.

With reference next to FIGS. 2, 3 and 9, the second pilot water hose 188 communicates water from the outlet 186 of the rectifier-regulator assembly 105 to a water inlet 200 of a fuel cooler 100. As best shown in FIG. 9, the fuel cooler 100 comprises a fuel passage 202 and a coolant passage 204 enclosed within a heat exchange block 206 and disposed adjacent one another. The fuel and coolant passages 202, 204 each have inlets 210, 200 and outlets 212, 214 of reduced cross-sectional size relative to the respective passages 202, 204. Pilot cooling water that has passed through the rectifier-regulator assembly 105 is delivered to the water inlet connector 200 of the fuel cooler 100. The fuel passage 202 receives fuel that has been pressurized by the high pressure fuel pump. The pilot cooling water flowing through the coolant passage 204 absorbs heat from the fuel passing through the fuel passage 202.

The block 206 preferably comprises a material having advantageous heat transfer characteristics, such as an aluminum-based alloy or a copper-based alloy. The fuel passage 202 and cooling passage 204 preferably comprise material having advantageous corrosion resistance properties, such as brass or stainless steel.

Pilot cooling water exits the fuel cooler coolant passage 204 through the water outlet connector 214, to which a third section 218 of rubber pilot water hose is connected. As with the connectors 160, 184, 186 discussed above with reference to the upstream end 142 of the pilot water passage 140 and the rectifier-regulator 105, the fuel cooler 100 water connectors 200, 214 have inner diameters d3, d4 that are greater than or equal to the maximum dimension D of the water inlet cover openings 130. Since the connectors have the smallest diameter of the pilot water passage through the fuel cooler assembly 100, any debris or foreign matter within the pilot water cooling passage 140 will pass through the fuel cooler assembly without plugging or blocking the passage 204 therethrough.

Cooling the fuel is advantageous because, except under very cold conditions, the fuel generally should not be heated or warmed by engine heat. Excessive heating can cause the fuel to vaporize or can otherwise decrease fuel density. By cooling the fuel, the likelihood of vapor lock and/or deposit in the fuel injectors can be decreased. In addition, the accuracy of the fuel injection amount can be improved by cooling the fuel to a pre-set temperature range and maintaining the fuel temperature in this general range. It is to be understood that a fuel cooler 100 having any suitable manner of heat exchanger construction can also be disposed along the fuel system at other locations. For example, one or more fuel coolers can be disposed directly on one or more fuel rails.

Figure 10:
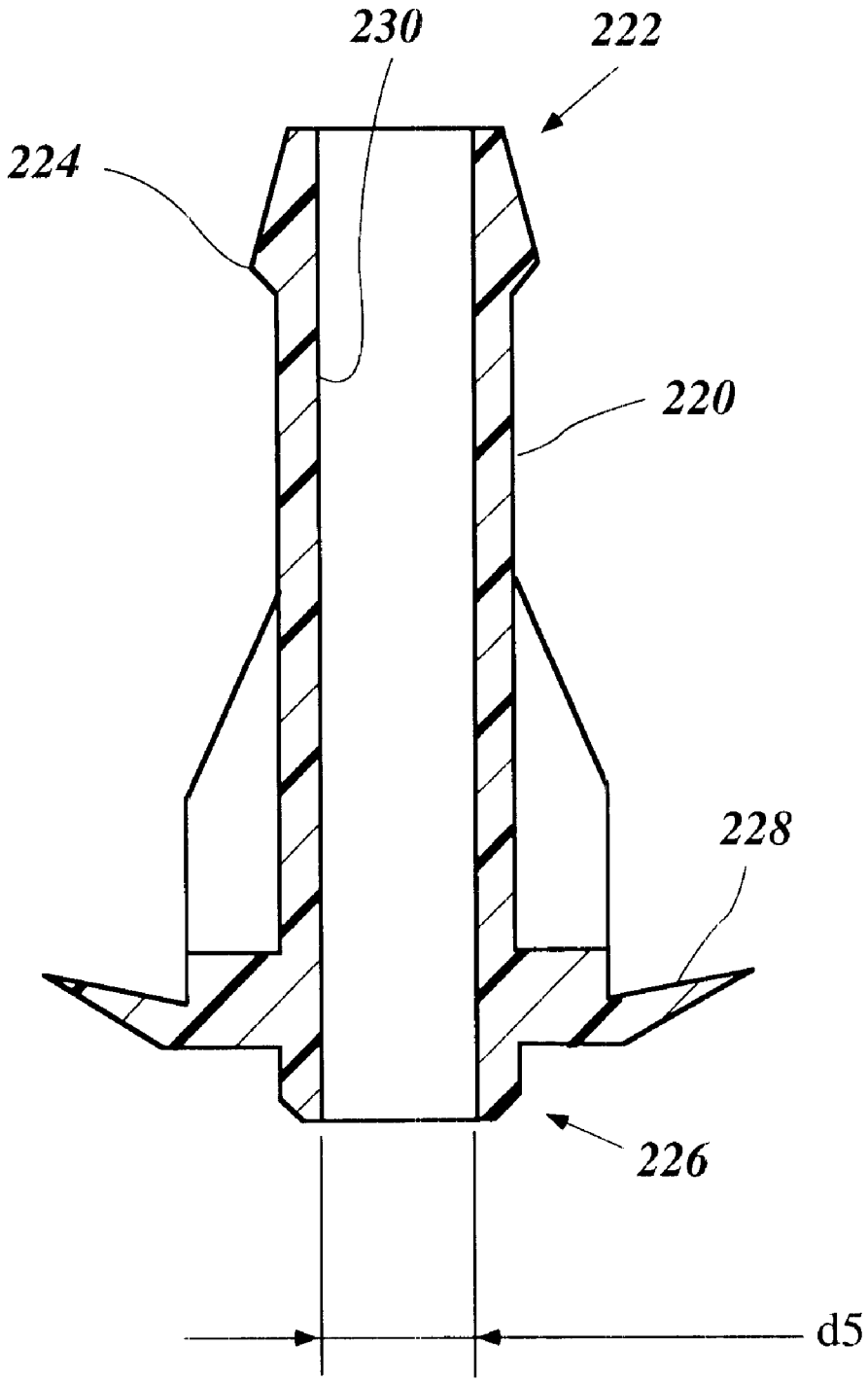
FIG. 10 is a sectional view of a discharge nozzle of the pilot water passage of FIG. 2.

With reference again to FIGS. 2 and 3, the pilot water passage 140 terminates at a pilot water discharge nozzle 220, through which water is discharged from the passage. FIG. 10 shows a cross-sectional view of the nozzle 220. An upstream end 222 of the nozzle 220 includes a ridge portion 224 and is configured so that the third pilot water hose 218 can be securely held thereon. A downstream end 226 of the nozzle includes a flange 228 configured to hold the nozzle 220 adjacent an outer surface of the cowling 60. An elongate inner passage 230 communicates coolant water from the pilot water passage 140 out of the motor 30. The inner passage 230 preferably is tapered so that the inner diameter decreases from the upstream end 222 to the downstream end 226. This helps to increase the velocity of the pilot water flow so that the stream of discharged pilot water is easily visible to the watercraft operator. However, the smallest diameter d5 of the inner passage 230 is still greater than or equal to the maximum dimension D of the water inlet cover openings 130. It is to be understood that, in additional embodiments, the nozzle's inner passage can have a generally uniform diameter.

In the illustrated embodiment, the connectors 160, 184, 186, 200, 214 and discharge nozzle 220 have the smallest diameter of any portion of the pilot water passage 140, including the sections of rubber tubing 164, 188, 218 and the heat exchange blocks 172, 206. However, each of the connectors and the nozzle still has an inner diameter greater than or equal to the maximum dimension D of the water inlet cover openings 130. As such, no portion of the pilot water passage 140, which extends from the hole 150 that accesses the engine coolant passage 110 to the downtream end 226 of the nozzle 200, has a diameter less than the maximum dimension D. Any debris or foreign matter that is small enough to be drawn through the openings 130 is also small enough to pass completely through the pilot water passage 140 without blocking or otherwise impeding the flow of water therethrough. Additionally, since the coolant is pressurized, there is further impetus to force such debris through the pilot water passage 140. Accordingly, no filter is required at the junction where the pilot water passage 140 branches off of the engine coolant passage 110.

In an additional embodiment, portions of the pilot water passage may have an inner diameter less than the inner diameter of the connectors; however, the inner diameter of the pilot water passage preferably is never less than the maximum dimension D of the water inlet cover openings 130.

In the illustrated embodiment, and as shown in FIGS. 2 and 3, the pilot water passage 140 directs relatively cool water through a rectifier-regulator assembly 105 and through a fuel cooler before directing the water out of the discharge nozzle 220 and back to the body of water from which the water was obtained. It is to be understood, however, that additional embodiments can use the pilot water passage to cool any number of engine components. For example, components of the flywheel, lubrication system, induction system, and even the ECU can advantageously be cooled by pilot water.

Since the pilot water passage 140 connects to the upstream portion of the engine coolant passage, the coolant has not yet absorbed much heat from the engine, and is relatively cool. Accordingly, this coolant can cool engine components more effectively than coolant taken from a point further downstream in the engine coolant passage, which will have absorbed significant heat from the cylinder bores and the like.

In the illustrated embodiment, the pilot water passage 140 branches off of the engine coolant passage from an exhaust manifold water jacket. It is to be understood, however, that a pilot water passage can be branched off of the engine coolant passage at any point along the passage such as, for example, from a water jacket in the cylinder bore or cylinder head of the passage. Additionally, in another embodiment, a pilot water passage branches off of the water delivery conduit 118 before the conduit delivers water to the engine coolant passage. Still further, the pilot water passage can have its own delivery conduit separate from the conduit 118 that delivers water to the engine coolant passage.

The rectifier-regulator 105 and fuel cooler 100 discussed above each comprise heat exchanger blocks 172, 206 through which pilot cooling water flows in order to absorb heat. It is to be understood that these blocks represent examples of heat exchangers, and that any suitable type or style of heat exchanger can advantageously be used.

Although this invention has been disclosed in the context of certain preferred embodiments and examples, it will be understood by those skilled in the art that the present invention extends beyond the specifically disclosed embodiments to other additional embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An outboard motor comprising a power head having an engine, a driveshaft housing, a lower unit comprising a propulsion device, and an open loop cooling system, the engine driving the propulsion device and having an engine body, the cooling system comprising a water inlet formed through the lower unit and having at least one opening, an engine coolant passage formed in the engine body, and a pilot water passage, the pilot water passage receiving a flow of water from the water inlet and directing the flow of water through at least one engine component, and a minimum cross-sectional dimension of the pilot water passage along its length is never less than a maximum cross-sectional dimension of the at least one water inlet opening.

2. The outboard motor of claim 1, wherein the pilot water passage branches off of the engine coolant passage.

3. The outboard motor of claim 2, wherein there is no filter adjacent an upstream end of the pilot water passage.

4. The outboard motor of claim 2, wherein the engine coolant passage comprises an exhaust cooling jacket and an engine body cooling jacket, and the pilot water passage branches off of the exhaust cooling jacket.

5. The outboard motor of claim 2, wherein the pilot water passage branches off of the engine coolant passage before water in the engine coolant passage absorbs significant heat from engine components.

6. The outboard motor of claim 1, wherein a water pump pressurizes water from the water inlet and delivers pressurized cooling water through a water delivery conduit, and the pilot water passage branches off the water delivery conduit upstream of the engine coolant passage.

7. The outboard motor of claim 1, wherein the pilot water passage delivers cooling water adjacent at least one peripheral engine component before being discharged from the drive.

8. The outboard motor of claim 7, wherein the peripheral component comprises a rectifier-regulator assembly having a heat exchanger portion.

9. The outboard motor of claim 7, wherein the peripheral component comprises a fuel cooler.

10. The outboard motor of claim 7, wherein the pilot water passage comprises tubing, and the peripheral engine component comprises a connector configured to engage the tubing, and a minimum dimension of the connector no less than the maximum dimension of the at least one water inlet cover opening.

11. The outboard motor of claim 7, wherein the water inlet comprises at least one aperture formed through the lower unit, and a cover is disposed in the aperture, the cover having a curvature generally matching a curvature of the lower unit adjacent the aperture, and the at least one opening is formed through the cover.

12. A marine drive comprising an engine, a propulsion device, and an open loop cooling system, the engine coupled to the propulsion device and having an engine body, the cooling system comprising a water inlet having at least one opening, an engine coolant passage formed in the engine body and having an engine coolant discharge, a pilot water passage, a water pump configured to deliver water from the water inlet to the engine coolant passage and pilot water passage, the pilot water passage directing a flow of water through a pilot water discharge that is spaced from the engine coolant discharge, and a cross-sectional dimension of the pilot water passage along its length is no less than a maximum cross-sectional dimension of the at least one water inlet opening.

13. The marine drive of claim 12, wherein a water delivery conduit delivers cooling water to the engine coolant passage and the pilot water passage, and the pilot water passage receives cooling water from the delivery conduit at a point upstream of the engine coolant passage.

14. The marine drive of claim 12, wherein the pilot water passage has a generally circular cross-section through its length, and a minimum diameter of the pilot water passage along its length is no less than the maximum cross-sectional dimension of the at least one water inlet opening.

15. The marine drive of claim 12, wherein the pilot water passage branches off of the engine coolant passage before the cooling water absorbs substantial heat from the engine body.

16. The marine drive of claim 12, wherein the marine drive comprises an outboard motor, and the engine is disposed generally within a cowling of the outboard motor.

17. The marine drive of claim 16, wherein the pilot water discharge is formed through the cowling.

18. The marine drive of claim 16, wherein at least one peripheral engine component is disposed along the pilot water passage so that the pilot water passage delivers cooling water adjacent or through the engine component.

19. The marine drive of claim 18, wherein the at least one peripheral engine component is arranged within a space between the engine body and the cowling.

20. The marine drive of claim 18, wherein the at least one peripheral engine component comprises a heat exchanger having an inlet connector and an outlet connector.

21. The marine drive of claim 20, wherein the pilot water passage comprises at least two sections of flexible hose configured to securely engage the connectors, and the connectors each have an inner diameter greater than the maximum dimension of the at least one water inlet cover opening.

22. The marine drive of claim 21, wherein the peripheral engine component comprises an electrical component.

23. The marine drive of claim 22, wherein the peripheral engine component comprises a rectifier-regulator assembly.

24. The marine drive of claim 22, wherein the peripheral engine component comprises an ECU.

25. The marine drive of claim 21, wherein the peripheral engine component comprises a fuel cooler.

26. The marine drive of claim 18, wherein the pilot water passage delivers cooling water through a plurality of peripheral engine components.

* * * * *